United States Patent [19]

Jarman

[11] 3,992,919

[45] Nov. 23, 1976

[54] SHEET METAL PULLING POWER HEAD AND STAND

[75] Inventor: Davis R. Jarman, Brunswick, Ga.

[73] Assignee: Virgil Hinson, Brunswick, Ga. ; a part interest

[22] Filed: Sept. 9, 1974

[21] Appl. No.: 504,114

[52] U.S. Cl. ..... 72/447; 72/705; 72/457; 254/51; 254/93 R; 254/190 R; 85/5 P

[51] Int. Cl.² ..... B21D 1/12

[58] Field of Search ..... 72/705, 447, 457; 85/5 P; 254/51, 78, 81, 93 R, 139, 139.1, 190 R, 166; 248/121, 124, 125, 158, 177, 201

[56] References Cited

UNITED STATES PATENTS

| | | | |
|---|---|---|---|
| 489,193 | 1/1893 | Mills | 254/139 |
| 790,343 | 5/1905 | Channon | 254/190 R |
| 2,201,831 | 5/1940 | Jacque | 254/190 R |
| 2,599,207 | 6/1952 | Spahr et al. | 85/5 P X |
| 2,695,690 | 11/1954 | Rees et al. | 85/5 P UX |
| 3,062,502 | 11/1962 | Pelletier | 254/51 |
| 3,122,194 | 2/1964 | Bronson et al. | 72/705 X |
| 3,340,720 | 9/1967 | Chartier | 72/705 X |
| 3,544,432 | 8/1973 | Hagerty | 72/705 X |
| 3,566,667 | 3/1971 | Hagerty | 72/705 X |
| 3,590,623 | 7/1971 | Hunnicutt | 72/705 X |
| 3,698,230 | 10/1972 | Buske | 72/705 X |
| 3,720,398 | 3/1973 | Grise | 254/51 |
| 3,789,652 | 2/1974 | Buske | 72/705 X |
| 3,893,329 | 7/1975 | Roes | 72/705 X |

FOREIGN PATENTS OR APPLICATIONS

| | | | |
|---|---|---|---|
| 538,551 | 3/1957 | Canada | 254/51 |

*Primary Examiner*—Milton S. Mehr
*Assistant Examiner*—D. M. Gurley
*Attorney, Agent, or Firm*—Clarence A. O'Brien & Harvey B. Jacobson

[57] ABSTRACT

A pulling apparatus having a stand which supports a chain connected between a floor anchor and a piece of sheet metal, and the like, to be straightened. A power head is arranged engaging the chain for tightening same. The power head may be disposed along an open run of the chain, or alternatively may be mounted on the stand in place of a pulley which normally guides the chain over the stand. A plurality of hangers are provided at different heights on the frame for receiving the pulley or power head.

8 Claims, 11 Drawing Figures

2
15
54
16
2
4
18
22
24
61
64
30
26
70
34
4
20
32
10
26
28
12
14
12
64
66
72
70
74
68
62

FIG. 9
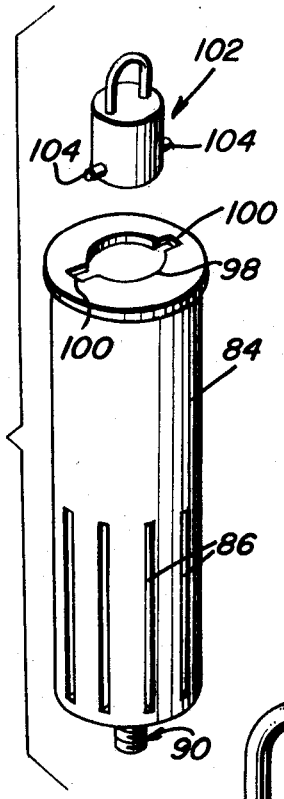
FIG. 10
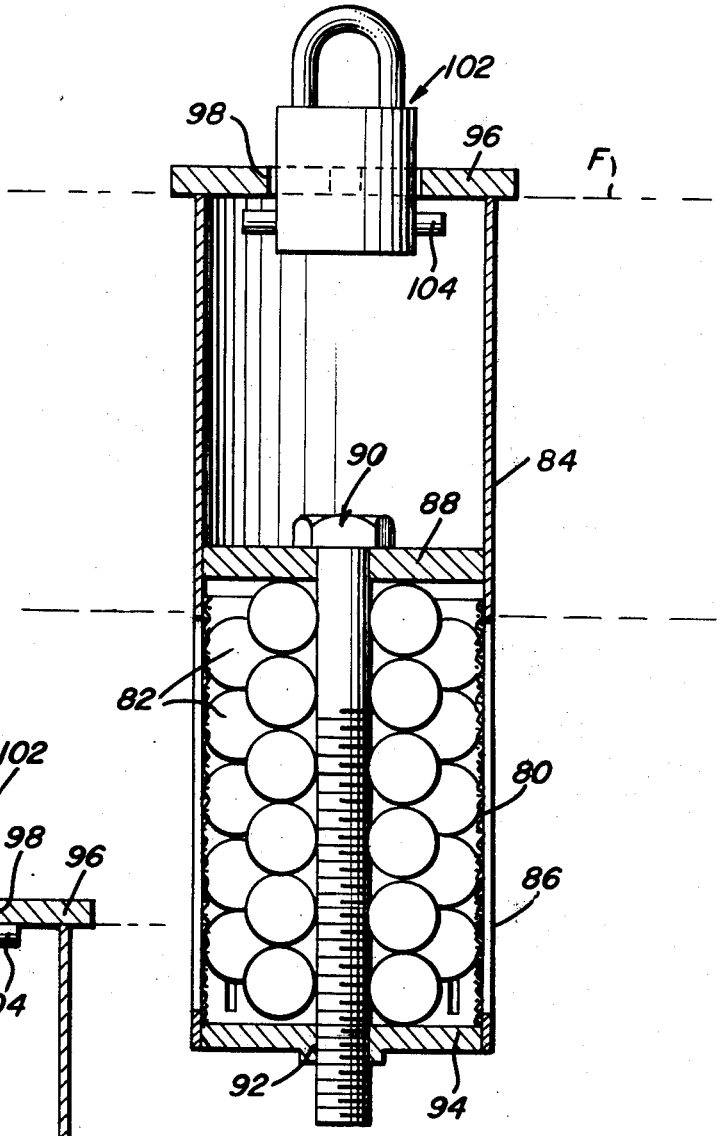
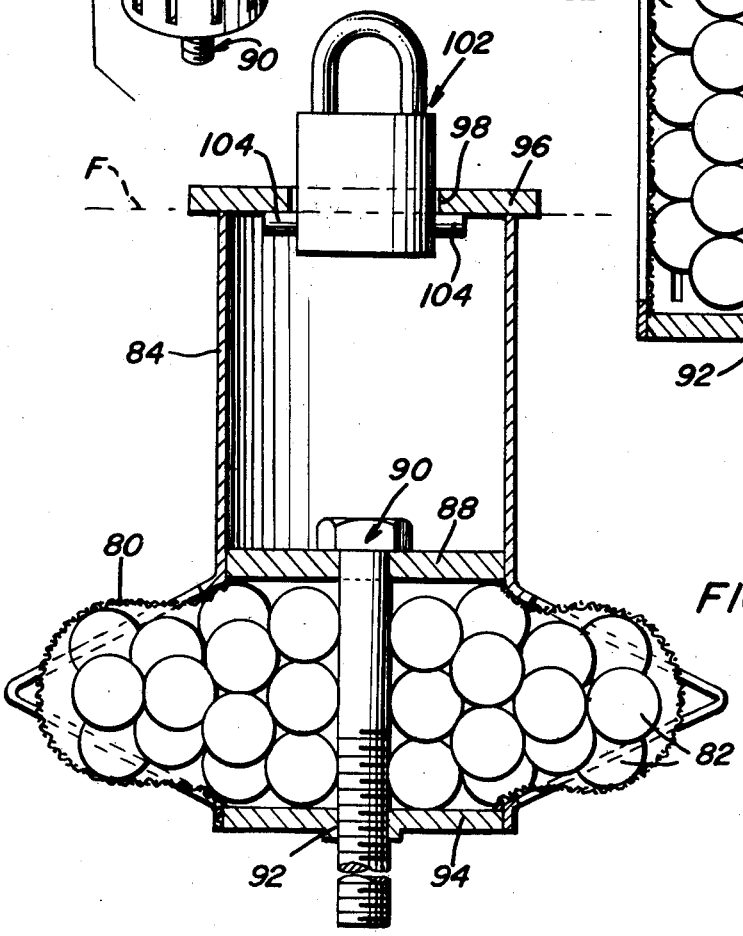
FIG. 11

SHEET METAL PULLING POWER HEAD AND STAND

BACKGROUND OF THE INVENTION

1. Field of the Invention

This invention relates generally to pulling apparatus, and particularly to apparatus for pulling sheet metal on unitized automobile bodies, and the like.

2. Description of the Prior Art

Patents believed pertinent to this invention are as follows:

| | | |
|---|---|---|
| U.S. Pat. No. | 3,566,667 | Mar. 2, 1971 |
| U.S. Pat. No. | 3,589,680 | Apr. 29, 1971 |
| U.S. Pat. No. | 3,590,623 | July 6, 1971 |
| U.S. Pat. No. | 3,754,427 | Aug. 28, 1973 |

SUMMARY OF THE INVENTION

It is an object of the present invention to provide an improved pulling apparatus having more versatility than known apparatus of this kind.

It is another object of the present invention to provide a pulling apparatus especially suited for straightening sheet metal on vehicle bodies.

It is still another object of the present invention to provide a pulling apparatus which will align itself with damaged sheet metal before and during the pulling operation.

These and other objects are achieved according to the present invention by providing a pulling apparatus having: a stand; an anchor; a flexible member connected to the anchor and supported by the stand for being connected to an element to be straightened; and a power head arranged engaging the flexible member for tightening same.

A preferred stand according to the present invention has a vertically upstanding frame forming a tower, a base supporting the frame, and at least one hanger mounted on the frame for selectively receiving either the power head or a pulley arrangement which guidingly engages the flexible member. Advantageously, the tower is provided with a plurality of hangers arranged spaced out along the tower forming frame from the base associated therewith.

Each of the hangers may include a pair of cantilever elements having free ends provided with slots arranged for alternately receiving portions of the head member or pulley. These cantilever elements are desirably arranged extending at an acute upward angle from the frame.

A preferred power head according to the present invention includes a support member, a pair of rollers mounted on the support member for guiding the flexible member, and a fluid motor mounted on the support member and including a piston rod having a free end which engages the flexible member for moving same between the rollers for tightening the flexible member.

One form of an anchor according to the present invention suitable for use with the aforementioned pulling apparatus includes a receptable provided with a central aperture and opposed recesses. A bolt is insertable into the aperture and is provided with transverse pins cooperable with the recesses for permitting the bolt to be retained in the receptacle by turning the bolt to remove the pins from the area of the recesses.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 9 is an exploded perspective view showing an alternate form of an anchor which forms part of a pulling apparatus according to the present invention.

FIG. 10 is a vertical sectional view showing the anchor of FIG. 9.

FIG. 11 is a vertical sectional view similar to FIG. 10, but showing the anchor in the anchored mode thereof.

DESCRIPTION OF THE PREFERRED EMBODIMENT

Figures 1, 6:
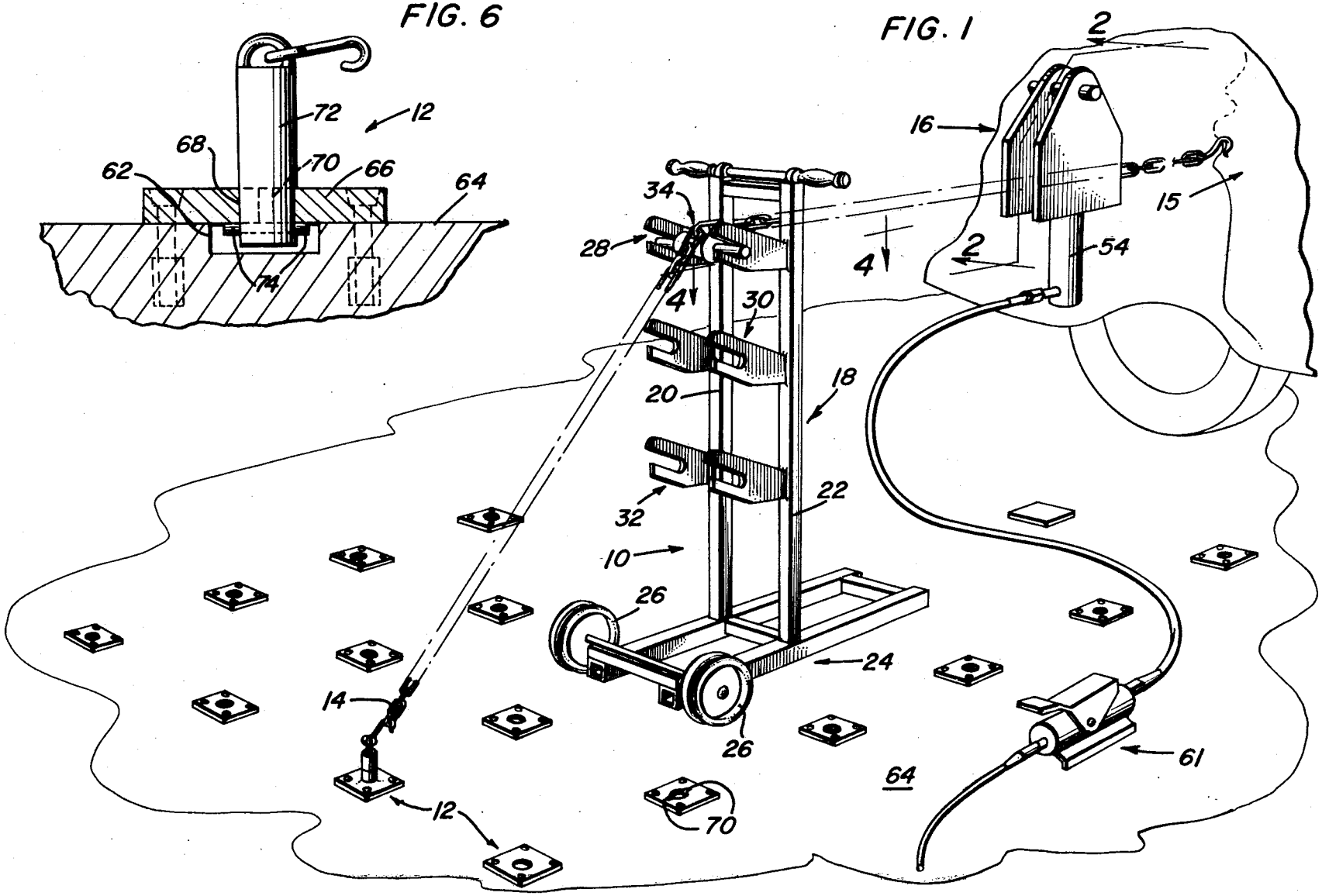
FIG. 1 is a fragmentary, perspective view showing a pulling apparatus according to the present invention.
FIG. 6 is a fragmentary, vertical sectional view showing an anchor which forms part of a pulling apparatus according to the present invention.
Figure 4:
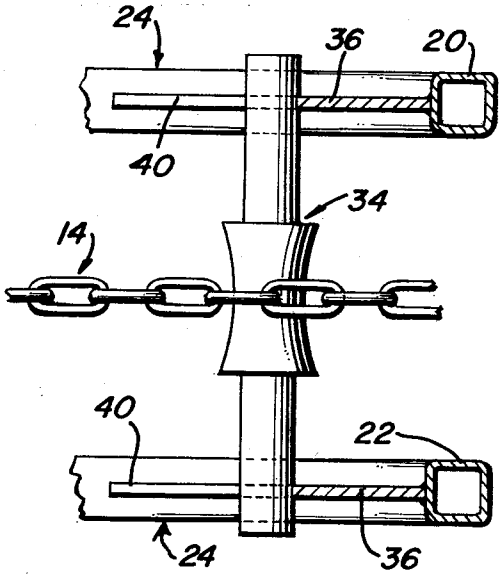
FIG. 4 is a fragmentary, sectional view taken generally along the line 4—4 of FIG. 1.

Referring now more particularly to FIG. 1 of the drawings, a pulling apparatus according to the present invention has a stand 10 and a plurality of associated anchors 12. Advantageously, anchors 12 are arranged in a predetermined grid or other pattern so as to be in proper positions for all contemplated pulling operations. A flexible member such as a chain 14 is connected to one of the anchors 12 and is supported by stand 10 for being connected to, for example, damaged sheet metal 15 of a vehicle body, and the like, for pulling same into a straightened position. A power head 16 is arranged engaging chain 14 for tightening same in a manner to be described below. Stand 10 includes a vertically upstanding frame 18 arranged for forming a tower. Frame 18 itself is constructed from a pair of parallel rails 20 and 22 supported by a base 24 and having suitable cross bracing. Wheels 26 may be provided on base 24 for facilitating movement and positioning of stand 10. A plurality of hangers, three hangers, 28, 30, and 32 being shown, are mounted on frame 18 for selectively receiving either power head 16 (FIG. 8) or a pulley arrangement 34 (FIG. 4) selectively mountable on one of hangers 28, 30, 32 for guiding chain 14.

As can be readily appreciated from FIG. 1 of the drawings, the hangers are arranged spaced out along the frame from base 24 so as to permit guiding of chain 14 at different heights with respect to stand 10.

Figure 8:
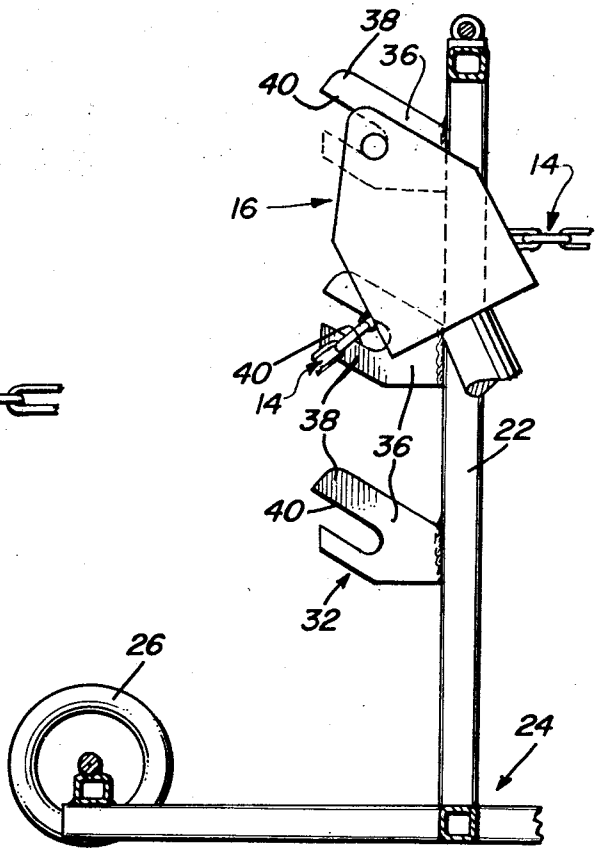
FIG. 8 is a fragmentary, vertical sectional view showing the power head arranged on the stand so as to both guide and tighten the chain.

As perhaps can best be seen from FIG. 8 of the drawings, each hanger 28, 30, and 32 includes a pair of cantilever elements 36 having free ends 38 provided with slots 40 arranged for receiving portions of either power head 16 or pulley arrangement 34. As can be readily seen from FIG. 8, elements 36 are arranged extending at an acute upward angle from the rails 20 and 22 on which they are mounted.

Figure 3:
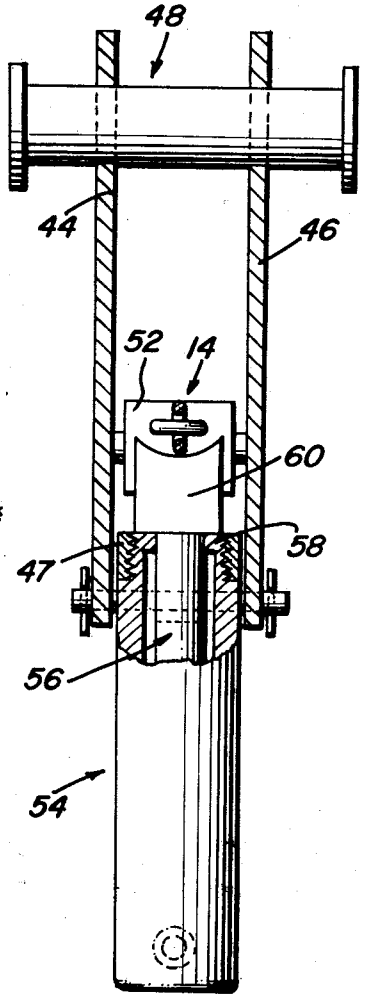
FIG. 3 is a sectional view taken generally along the line 3—3 of FIG. 2.
Figure 2:
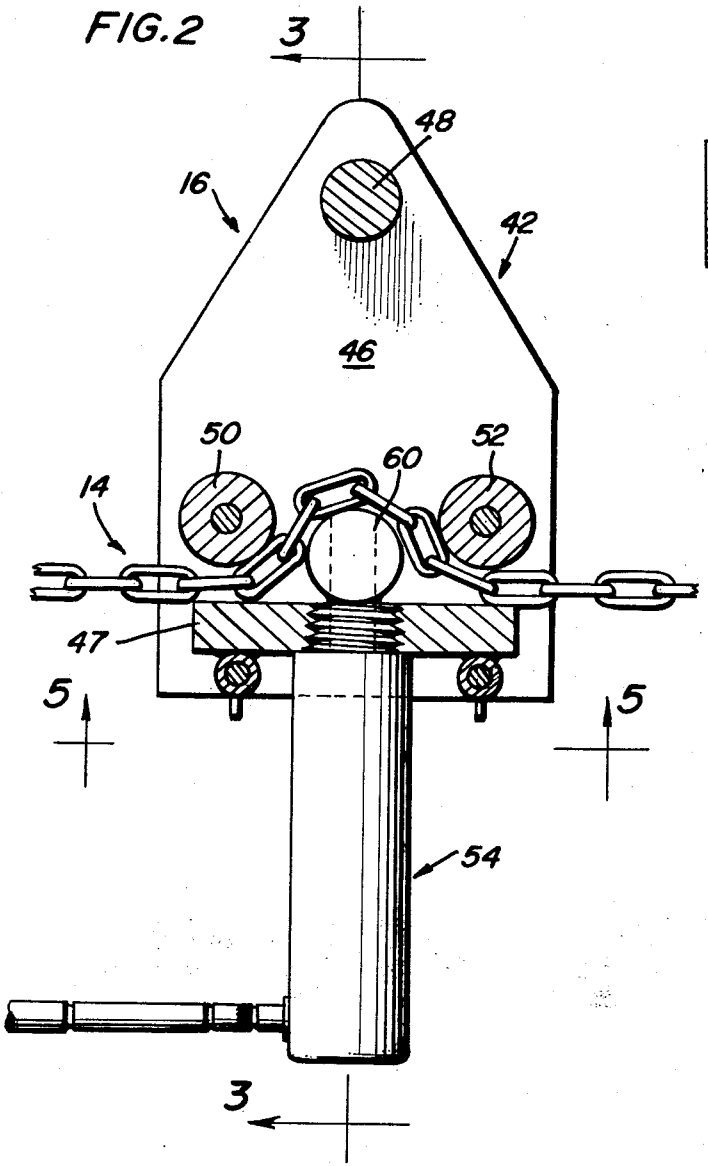
FIG. 2 is a fragmentary, sectional view taken generally along the line 2—2 of FIG. 1.
Figure 5:
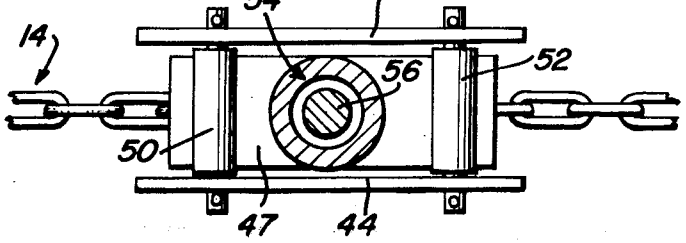
FIG. 5 is a fragmentary, sectional view taken generally along the line 5—5 of FIG. 2.

Referring now to FIGS. 2, 3, and 5 of the drawings, power head 16 includes a support member 42 formed by a pair of substantially parallel side plates 44 and 46. A mounting plate 47 is arranged between plates 44, 46 for helping to space same and to provide a mounting block for a purpose to become apparent below. The illustrated cotter pin retained rods may be employed to attach plates 44 and 46 in bracing relationship with respect to plate 47. A pin 48 arranged passing through apertures provided in the upper portions of plates 44 and 46 completes support member 42, and provides bearing surfaces for permitting power head 16 to be mounted on hangers 28, 30, and 32. A pair of rollers 50 and 52 are mounted between plates 44 and 46 in a conventional manner for guiding chain 14. These rollers 50, 52 are spaced from one another, and a fluid motor 54 is mounted on plate 47 as by the illustrated screw threads provided in an aperture provided in plate 47. This fluid motor 54 includes a piston rod 56 having a free end 58 and a disc 60 mounted on the free end 58. Disc 60 is arranged for being moved by piston rod 56 between rollers 50 and 52 for tightening chain 14 by forming a loop therein.

Referring again to FIG. 1 of the drawings, a conventional footoperated fluid valve 61 is illustrated as being inserted in the hose which connects fluid motor 54 to a suitable source (not shown) of, for example, hydraulic fluid. This valve 61 permits an operator (not shown) to actuate fluid motor 54 while leaving the operator's hands free to perform other tasks.

FIG. 6 of the drawings shows a possible construction for anchor 12. In this anchor embodiment, a receptacle 62, or recess, is provided in the floor 64 used for supporting stand 10. A receptacle covering cover plate 66 is arranged over receptacle 62 and is provided with a central aperture 68 which communicates with opposed recesses 70. A bolt 72, which is connectible to chain 14, is insertable into aperture 68, and is provided with transverse pins 74 cooperable with recesses 70 for permitting bolt 72 to be retained in receptacle 62 by turning bolt 72 to remove pin 74 from the area of recesses 70. In this manner, pins 74 will prevent bolt 72 from being removed from receptacle 62 through plate 66 unless pins 74 are aligned with recesses 70. Plate 66 may be secured to floor 64 as by the illustrated bolt.

Figure 7:
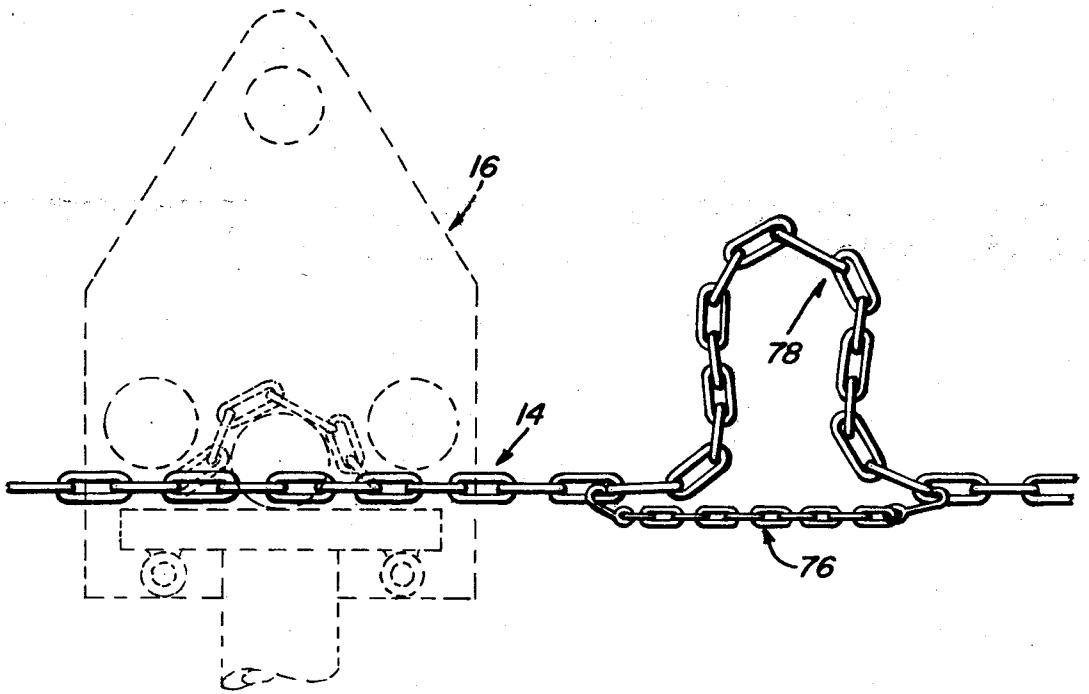
FIG. 7 is a fragmentary, side elevational view, showing a chain tie-off arrangement according to the present invention.

FIG. 7 of the drawings shows a chain 76 provided with hooks at either end which engage links of chain 14 to tie off the latter across the opening of a loop 78 that has been previously formed by power head 16. By retaining chain 14 in a tightened position by use of chain 76, power head 16 can be moved to another position along chain 14, as shown in broken lines in FIG. 7, to exert additional pull on the sheet metal, and the like, being straightened.

Referring now to FIGS. 9 through 11 of the drawings, the anchor bolt shown in these figures may be used in place of the anchor 12 shown in FIG. 6 of the drawings. This expandable anchor bolt includes an expandable housing in the form of sleeve 80 constructed from a conventional wire mesh, and the like. A plurality of balls 82 are arranged in sleeve 80 to form a fluid material contained by sleeve 80. Both sleeve 80 and balls 82 are arranged within a generally cylindrical casing 84 provided with a plurality of slots 86. A piston 88 arranged within casing 84 is actuatable by a bolt 90 passing through a hole in piston 88 and threadingly engaging in an internally threaded bore 92 provided in plate 94 which encloses the lower end of casing 84. As will be appreciated, movement of piston 88 toward plate 94 by tightening of bolt 90 will cause balls 82 and sleeve 80 to extend through slots 86, which themselves will expand, and expand the lower portion of casing 84 so as to prohibit same, together with sleeve 80, from passing through a hole provided in a floor F. The latter mode is shown in FIG. 11 of the drawings. As can be appreciated from FIGS. 10 and 11, casing 84 is passed through a hole in floor F and then bolt 90 is turned so as to move piston 88 toward plate 94 and cause the aforementioned expansion of the lower portion of casing 84.

The upper portion of casing 84 is advantageously provided with a covering plate 96 similar to plate 66 in that it is provided with a central aperture 98 which communicates with opposed recesses 100. A lock bolt 102, similar to bolt 72, is insertable into aperture 98, and is provided with transverse pins 104 cooperable with recesses 100 for permitting lock bolt 102 to be retained in casing 84 by turning lock bolt 102 so that pins 104 are removed from the area of recesses 100. In this manner, pins 104, like pins 74, will prevent lock bolt 102 from being removed from casing 84 through plate 96 unless pins 104 are again aligned with recesses 100.

The expandable anchor bolt described immediately above is similar to the expandable anchor bolt disclosed in my application Ser. No. 474,079, filed May 28, 1974.

In operation, the power head and stand according to the present invention may be used for pulling sheet metal on unitized vehicle bodies, and the like, by connecting chain 14 to an anchor 12 and to the sheet metal 15. It will be appreciated that suitable expandable bolts may be used to secure plate 66 to floor 64, and a portion of the floor associated with aperture 68 is countersunk to form recess 70. Bolt 72, with chain 14 fastened thereto, is now inserted through aperture 68 for retention by plate 66. Once the chain is anchored to floor 64, stand 10 is positioned between the anchor 12 being employed and the vehicle to be pulled. Power head 16 may now be arranged in one of the hangers 28, 30, 32, or positioned on chain 14 and pulley arrangement 34 arranged in one of the hangers. These are the arrangements shown in FIGS. 8 and 1 of the drawings, respectively. If pulley arrangement 34 is employed, it is advantageous to arrange power head 16 adjacent the damaged area being straightened. Power head 16 is loaded by removing the cotter pins from the rods associated with plate 47 and letting the ram, or fluid motor 54, drop from power head 16 so that chain 14 can be placed under rollers 50, 52. Then fluid motor 54 can be re-locked to power head 16 by replacing the rods and cotter pins to re-attach plate 47 to the side plates 44, 46. After loading power head 16, fluid motor 54 is fully extended to form a loop such as loop 78, and if more pull is required, chain 14 may be tied off by means of chain 76 as is shown in FIG. 7. By tying off chain 14 in this manner, power head 16 may be released without untightening chain 14, and the power head re-located on chain 14 to exert the further pull required.

The plurality of hooks, or hangers 28, 30, and 32, permit positioning of either power head 16 or pulley arrangement 34 so as to align the effective point of pulling with the point where the sheet metal is being pulled. In this manner, a pulling apparatus according to the present invention will align itself with the damaged area being pulled. For example, if a fender is bent downwardly, power head 16 or pulley arrangement 34 can be initially aligned with the damaged area. Then as the metal is pulled out, power head 16 or pulley arrangement 34 will rise in slots 40 and align itself as the metal comes out. As can be appreciated, either the power head 16 or pulley arrangement 34, depending on which is arranged in one of the hangers 28, 30, and 32, functions as a pull bar for the pulling system. Pressure on the pull can be regulated by moving stand 10 closer to or further away from the, for example, vehicle, so that by proper selection of the pressure being exerted on the vehicle body the body will not be pulled into the stand. By arranging anchors 12 in such a manner that they would surround the area on floor 64 where the vehicle being pulled is positioned, it is possible in a simple and easy manner to pull on the vehicle from all angles.

It is to be understood that the power head and stand according to the present invention is versatile in application, and is not limited to use with automobiles, and the like.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

I claim:

1. A pulling apparatus, comprising, in combination: (a) a rigid stand including a vertically upstanding frame forming a tower, a base supporting the frame, and at least one hanger mounted on the frame;

b. an anchor;

c. a flexible member for being connected to a structure to be straightened and to the anchor; and d. a power head; wherein e. in a first arrangement of the elements, the power head is arrangeable on the hanger of the stand for guiding the flexible member, the power head being arrangeable swingingly suspended on the hanger and supporting the flexible member on the stand to form the first arrangement of the elements, and a second arrangement of the elements wherein the power head is supportable by the flexible member and additionally cooperates with the stand, anchor, and flexible member, with the second arrangement of the elements including a pulley arrangeable on the hanger of the stand and guidingly supporting the flexible member the power head being arranged engaging the flexible member to tighten the same.

2. A structure as defined in claim 1, wherein a plurality of hangers are mounted on the frame, the hangers being arranged spaced out along the frame from the base.

3. A structure as defined in claim 2, wherein each of the hangers includes a pair of cantilever elements having free ends provided with slots, the elements being arranged extending at an acute upward angle from the frame.

4. A structure as defined in claim 3, wherein the power head includes a support member, a pair of rollers mounted on the support member for guiding the flexible member, the rollers being spaced from one another, and a fluid motor mounted on the support member and including a piston rod having a free end and a disc mounted on the free end of the piston rod, the disc arranged for being moved between the rollers and tightening the flexible member by forming a loop therein.

5. A structure as defined in claim 6, wherein the anchor includes a receptacle covering cover plate provided with a central aperture and opposed recesses, and a bolt insertable into the aperture and provided with transverse pins cooperable with the recesses for permitting the bolt to be retained in the receptacle by turning the bolt to remove the pins from the area of the recesses.

6. A structure as defined in claim 1, wherein the hanger includes a pair of cantilever elements having free ends provided with slots, the elements being arranged extending at an acute upward angle from the frame.

7. A structure as defined in claim 1, wherein the power head includes a support member, a pair of rollers mounted on the support member for guiding the flexible member, the rollers being spaced from one another, and a fluid motor mounted on the support member and including a piston rod having a free end and a disc mounted on the free end of the piston rod, the disc arranged for being moved between the rollers and tightening the flexible member by forming a loop therein.

8. A structure as defined in claim 1, wherein the anchor includes a receptacle covering cover plate provided with a central aperture and opposed recesses, and a bolt insertable into the aperture and provided with transverse pins cooperable with the recesses for permitting the bolt to be retained in the receptacle by turning the bolt to remove the pins from the area of the recesses.

* * * * *